US007918680B2

(12) United States Patent
Schapira et al.

(10) Patent No.: US 7,918,680 B2
(45) Date of Patent: Apr. 5, 2011

(54) ROTATABLE LAMPHOLDER WITH SECURING ELEMENTS

(75) Inventors: Francisco Schapira, Valley Stream, NY (US); Anthony Tufano, North Massapequa, NY (US)

(73) Assignee: Leviton Manufacturing Company, Inc., Melville, NY (US)

( * ) Notice: Subject to any disclaimer, the term of this patent is extended or adjusted under 35 U.S.C. 154(b) by 314 days.

(21) Appl. No.: 12/056,675

(22) Filed: Mar. 27, 2008

(65) Prior Publication Data

US 2009/0244911 A1 Oct. 1, 2009

(51) Int. Cl.
*H01R 4/50* (2006.01)

(52) U.S. Cl. ..... 439/338

(58) Field of Classification Search ..... 439/338, 439/356, 668, 236, 332, 333, 324, 334, 375, 439/376, 617, 618
See application file for complete search history.

(56) References Cited

U.S. PATENT DOCUMENTS

| | | | | |
|---|---|---|---|---|
| 2,247,117 | A | 6/1941 | De Reamer | |
| 3,176,260 | A | 3/1965 | Pascucci | |
| 3,328,577 | A | 6/1967 | Pistey et al. | |
| 4,772,216 | A | 9/1988 | Szymanek | |
| 4,804,343 | A | 2/1989 | Reedy | |
| 5,746,615 | A * | 5/1998 | Ichikawa et al. | 439/227 |
| 5,758,952 | A | 6/1998 | Getselis et al. | |
| 5,816,837 | A | 10/1998 | Henrici et al. | |
| 6,039,597 | A | 3/2000 | Getselis et al. | |
| 7,097,327 | B1 | 8/2006 | Barton | |
| 2005/0225966 | A1 | 10/2005 | Hartmann et al. | |
| 2006/0133082 | A1 * | 6/2006 | Lingemann et al. | 362/249 |
| 2007/0066112 | A1 | 3/2007 | Tufano et al. | |
| 2007/0183160 | A1 | 8/2007 | Tufano et al. | |
| 2009/0244911 | A1 | 10/2009 | Schapira et al. | |
| 2010/0013391 | A1 | 1/2010 | Quercia et al. | |
| 2010/0081339 | A1 | 4/2010 | Galluccio et al. | |
| 2010/0265700 | A1 | 10/2010 | Galluccio et al. | |

FOREIGN PATENT DOCUMENTS

| | | |
|---|---|---|
| JP | 61-103887 | 7/1986 |
| JP | 62-104384 | 7/1987 |

OTHER PUBLICATIONS

Twist and Lock Compact Fluorescent Lampholder (2 pages) Disclosed prior to Mar. 27, 2007.
Lamp: Retention Mechanism (2 pages) Disclosed prior to Mar. 27, 2007.
Lamp: Locking Mechanism (2 pages) Disclosed prior to Mar. 27, 2007.
Twist and Lock Compact Fluorescent Lampholder (2 pages) Disclosed prior to Mar. 27, 2007.
International Search Report of PCT/US08/58441, dated Aug. 6, 2008.

* cited by examiner

*Primary Examiner* — Phuong K Dinh
(74) *Attorney, Agent, or Firm* — Collard & Roe, P.C.

(57) ABSTRACT

A lamp holder device for holding a light, the device comprising a body and a plurality of contacts disposed in the body. There is at least one rotatable top rotatably coupled to the body. In addition, there is at least one spring clip disposed in and secured to the body. The spring clip is for selectively securing a light to the spring clip when the light is inserted into the body and further secures the light to the body when the at least one rotatable top is rotated.

25 Claims, 17 Drawing Sheets

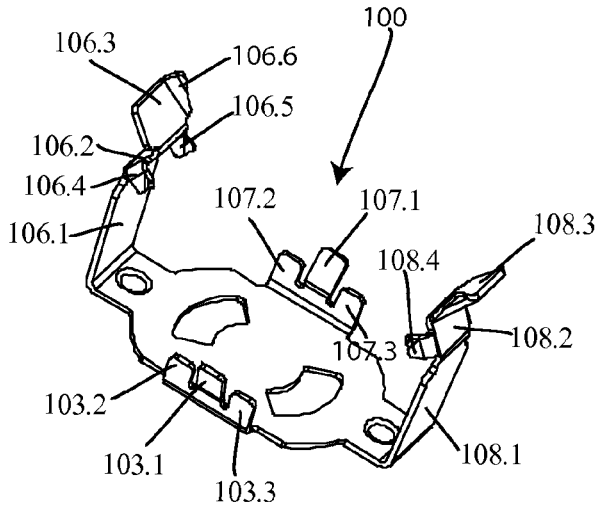
FIG. 2A
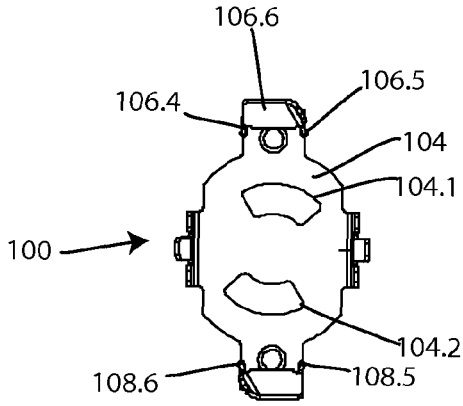
FIG. 2B
FIG. 2C
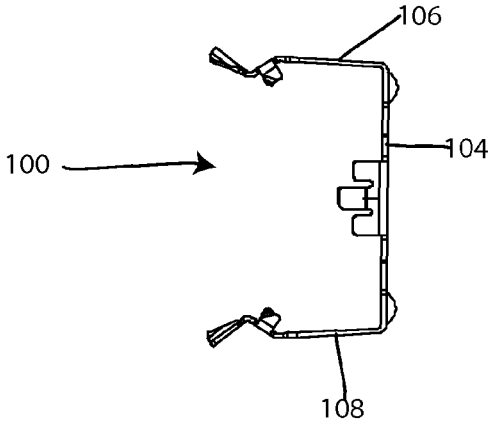
FIG. 2D
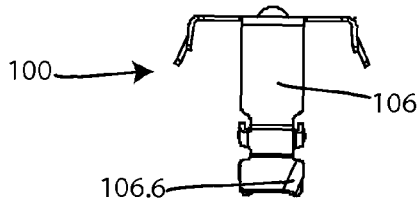

ROTATABLE LAMPHOLDER WITH SECURING ELEMENTS

BACKGROUND

The invention relates to a lamp holder which is attachable to a light such as a florescent light. The lamp holder can be attached to the florescent light in a rotatable manner such that once the light is inserted into the lampholder, it is rotated and then further secured into the lampholder.

SUMMARY

One embodiment of the invention relates to a lamp holder device for holding a light, the device comprising a body and a plurality of contacts disposed in the body. There is at least one rotatable top rotatably coupled to the body. In addition, there is at least one spring clip disposed in the body and rotatable top. The spring clip is for selectively securing a light to the body when the light is inserted into the lamp holder as well as when the at least one rotatable top is rotated. The spring clip can be made from resilient material such as metal, which withstands heat applied to the spring clip via the electrical conduction between the light and the lampholder. In addition this metal material does not degrade due to exposure to UV light which occurs with plastic components.

Another embodiment of the invention relates to a process for securing a light to a lamp holder. This process includes presenting a body, and a rotatable top, rotatably coupled to the body. Another step includes presenting at least one spring clip coupled to the rotatable top. Another step includes inserting a light into the spring clip, the rotatable top and the body. Once the light is inserted, it snaps into the spring clip for a first securing fit. In this position, the light can be removed from the lampholder body with some effort. Next, it can be rotated, wherein this rotation rotates the spring clip and the rotatable top. This rotational movement results in the further securing of the light to the body so that in this position, the light essentially cannot be pulled out from the lamp holder body. This additional securing occurs by a protrusion of the body pressing the spring clip against a base section of the light to secure the light in place. For example, in at least one embodiment, when the spring clip is rotated, arms on the spring clip contact inward extending protrusions on the light base which secure the arms of the spring clip in place securing the light to the lampholder.

At least one embodiment of the lamp holder can be assembled via a series of steps. The first two steps can occur in any order and can occur by inserting a plurality of contacts into a body. When the contacts are inserted into the body, they can be held in place by contact holders disposed in the body. In another step, a spring clip is coupled to a rotatable top. This spring clip is essentially inserted into the rotatable top so that it snaps in place and is secured by flanges or clips inserting into the rotatable top to secure the spring clip into the rotatable top. Next, the rotatable top is coupled to the body. In at least one embodiment, arms from the rotatable top extend through a bottom section of the body. These arms can have flanges to rotatably secure the rotatable top to the body.

Thus, at least one embodiment results in a durable, easily securable lamp holder that is relatively easy to assemble as well.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views:

FIG. 2A is a side perspective view of the spring clip shown in FIG. 1;

FIG. 2B is a top view of the clip shown in FIG. 2A;

FIG. 2C is a side view of the clip shown in FIG. 2A;

FIG. 2D is an end view of the clip shown in FIG. 2A;

DETAILED DESCRIPTION

Figure 1:
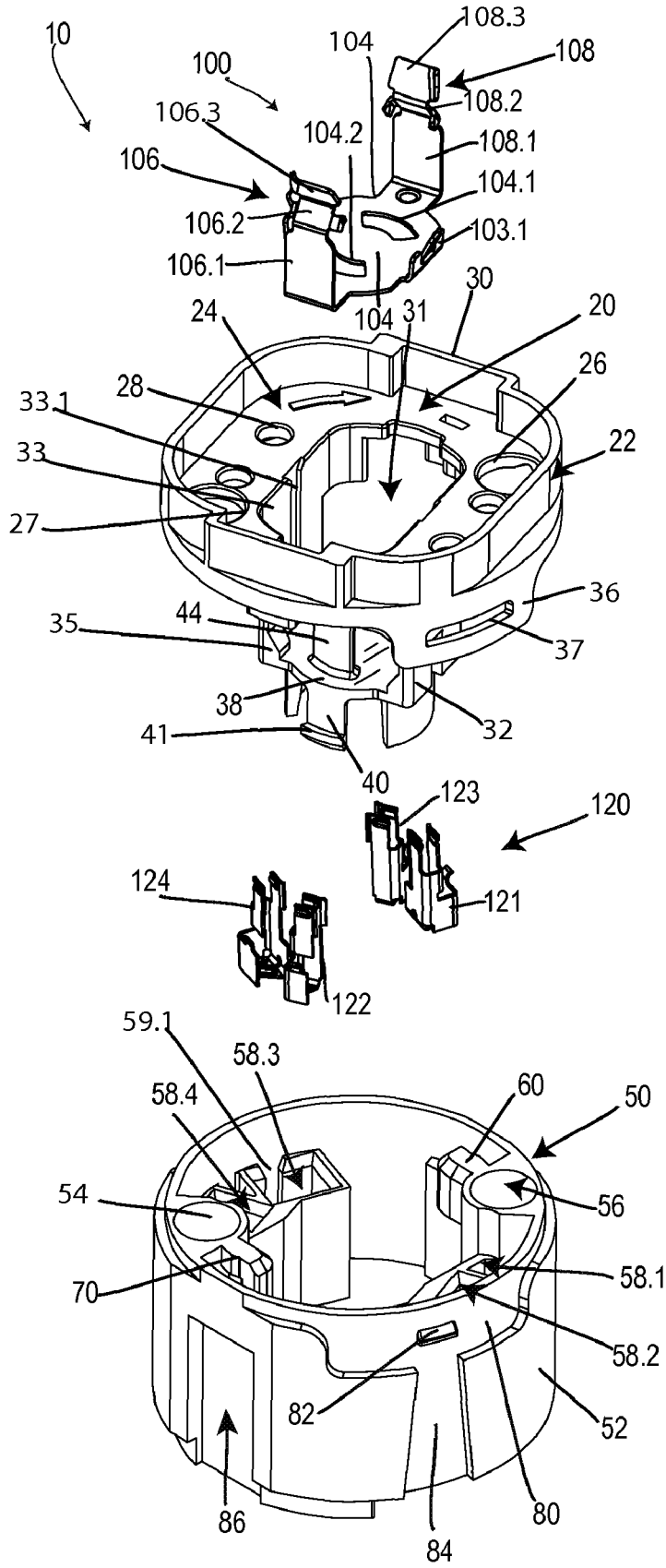
FIG. 1 is an exploded view of a first embodiment of the device.
Figure 3A:
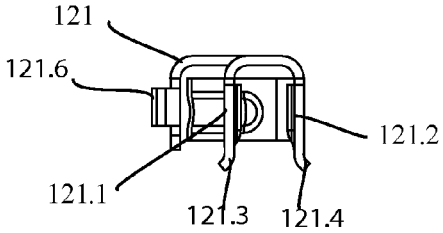
FIG. 3A is a top view of a contact.
Figure 3B:
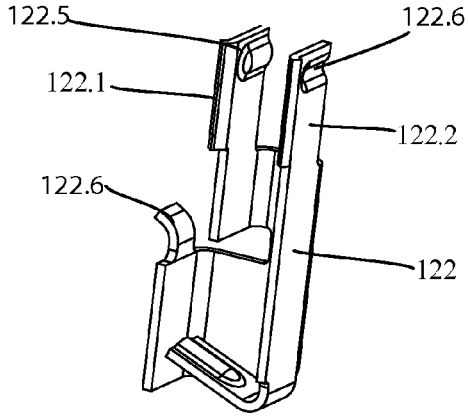
FIG. 3B is a side perspective view of the contact shown in FIG. 1.
Figure 3C:
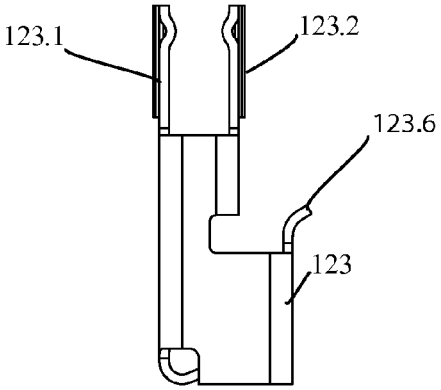
FIG. 3C is a side view of the contact.
Figure 3D:
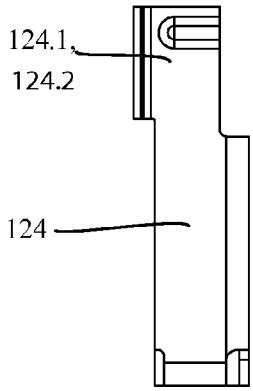
FIG. 3D is an end view of the contact.

FIG. 1 is an exploded view of a first embodiment of the invention. In this view there is shown a lamp holder device 10 which comprises a rotatable top 20, a base 50, a spring clip 100 and a plurality of contacts 120. Rotatable top 20 includes a rim 22, and a front surface 24 having holes 26 and 27 which are in the form of screw holes. These screw holes are for receiving screws which can be inserted into these screw holes and used to fasten base, 50 to a backing or panel. In this case, when the screws are inserted into holes 26 and 27 the heads of these screws extend into body 50 clear of rotatable top 20 to allow rotatable top 20 to rotate without being in contact with these screws.

In addition, there are holes 28 which are in the form of circular, symmetrical contact receiving holes for receiving contacts from a lamp or light. There are a plurality of indents 30 formed in rim 22 which are for alignment of a light once the light is inserted into this rotatable top 20. These indents also form a specific geometry for receiving a particular lamp base taken from a plurality of different lamp bases. In addition, there are support arms 32 and 33 which extend down from surface 24, forming support arms for supporting spring clip 100 within rotatable top 20 and also for supporting at least one locking clip 40. Support arms 32 and 33 have slots such as slot 33.1 for receiving spring clip 100 in a slotted manner. Support arms 32 and 33 extend down to a bottom surface 38. Bottom surface 38 has rejection elements 44 and 45 (See also FIG. 5) extending out from this surface. In addition, support arms 32 and 33 each have protrusions 34 and 35 (See FIG. 4D) for coupling to spring clip 100 once spring clip 100 is inserted into rotatable top 20. Essentially, when spring clip 100 is inserted into rotatable top 20, it slides down with clips 103.1 extending down through channel 33.1 and then extending out through openings 33.2 (See FIG. 5). These openings 33.2 act to lock spring clip 100 in place by receiving clip 103.1 through the hole.

An extending section 36 extends down from top section 24. Extending section 36 has a slot 37 which is elongated and extends in a curved manner.

In addition, a plurality of locking clips 40 extend down from base section 38 as arms. Locking clips 40 include a rim 41 which inserts into and around a center region of base 50. Locking clips are made from a flexible material such that when rotatable housing 20 is inserted into base 50 these locking clips 40 bend in and then snap out around shortened extension 53 (See FIG. 4C) to lock rotatable housing 20 in place (See FIG. 5).

Base 50 includes a body section 52 and a plurality of screw holes 54 and 56 for receiving screws that are inserted through holes 26 and 27 all the way into base 50. In addition, base 50 includes a plurality of contact holders 58.1, 58.2, 58.3 and 58.4 for holding associated contacts 120. Contact holders 58.1, 58.2, 58.3, and 58.4 also include slots such as slots 59.1. In addition, there is at least one protrusion 60 with one additional protrusion 70 as well. These protrusions form the dual purpose of securing rotatable top 20 in place to base 50 as well as providing inward lateral support forcing the arms of spring clip 100 inward to further secure an associated light into the spring clip which is in turn locked into the body 50. Body section 52 has slotted sections 80, 84, and 86 and a flange 82 in the form of a guide flange for guiding and securing rotatable top 20 on base 50. For example, when rotatable top 20 is secured onto base 50, extending section or arm 36 having slot 37 snaps over flange 82, wherein slot 37 is movable about this flange 82 while flange 82 locks this extending section to the body. Accordingly, slotted section 80 is for accommodating extending section 36 as extending section 36 is rotated. In addition, slotted section 86 is for securing base 50 to an associated stable platform.

Spring clip 100 fits inside rotatable top 20. Spring clip 100 is in the form of a substantially U-shaped clip having a base section 104 and arms 106 and 108. Base section 104 includes arcuate shaped openings 104.1 and 104.2 serving as rejection holes for receiving rejection elements 44 and 45 (See FIG. 5). Arm 106 includes a base section 106.1, an intermediate indent or notch section 106.2 and an upper section 106.3 forming a bridge or support section. In addition, there is an oppositely spaced arm 108 includes a base section 108.1, an intermediate or notch section 108.2, and an upper section 108.3 forming a bridge or support section. Base sections 106.1 and 108.1 of arms 106 and 108 are coupled to base section 104 in a spring like manner forming for example a leaf spring, such that these arms 106 and 108 can be flexibly bent back and forth in a lateral manner to selectively secure a light into base 50 (See FIG. 2C). Indent sections 106.2 and 108.2 form securing indents which when pressed over an associated flange on a base of a light (See FIG. 6) further secure the light into the base.

Arm 106 has clips 106.4, 106.5 and 106.6, (See FIG. 2A) which extend out from arm 106. Clips 106.4 and 106.5 form a channel on either side of notch section 106.2. In addition, clips 108.4, and 108.5 form a channel on either side of notch section 108.2 (See FIG. 2B). In addition, each arm 106 and 108 includes a flange 106.6 and 108.6 See FIGS. 2A and 2B) respectively, wherein these flanges form a rounded leading edge so as to assist clip 100 in rotating when a light is rotated.

Each of these channels formed in arms 106 and 108 are used to guide associated flanges on a light down along the channel such that these flanges are then slotted so that they can then be locked in place.

Figure 5:
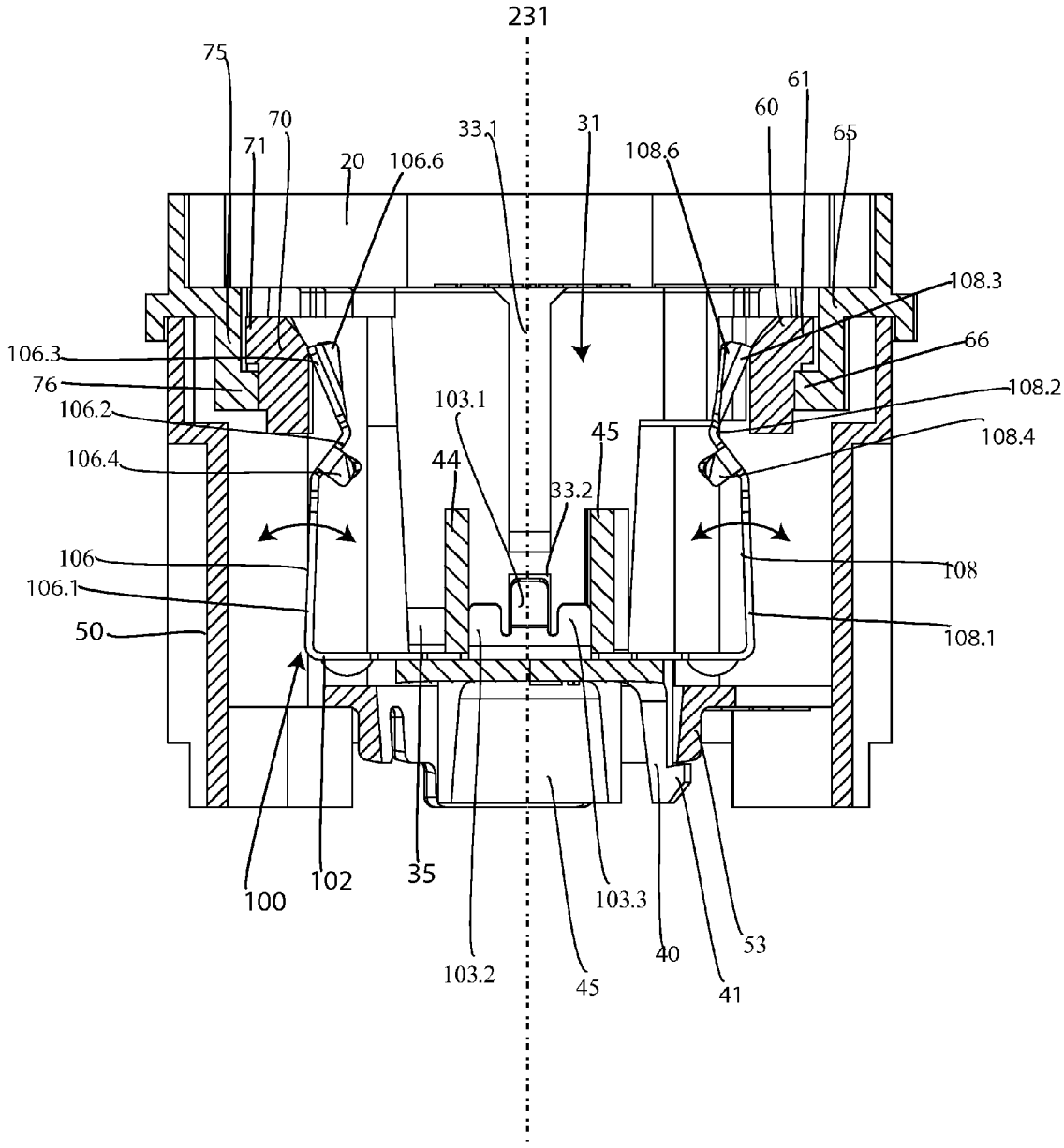
FIG. 5 is a side cross sectional view of the embodiment shown in FIG. 1.

FIGS. 2A-2D show the different views of spring clip 100. In this case, clips or tabs 107.1, 107.2 and 107.3 are also shown and are positioned opposite clips or tabs 103.1, 103.2 and 103.3. These clips act as flexible fingers locking spring clip 100 into rotatable top 20 by snapping in place. For example, as shown in FIG. 5 clips 103.2 and 103.3 are shown pressed against an outer peripheral wall of body 50 but between protrusions 34 and 35 to secure spring clip 100 to rotatable top 20 to prevent against lateral movement of spring clip 100 vs. the rotatable top.

FIG. 1 also shows base 50 is also adapted to receive a plurality of contacts 120 including contacts 121, 122, 123, and 124 which are adapted to fit into contact holders 58.1, 58.2, 58.3, and 58.4. When these contacts 120 fit inside the associated contact holders 58, they stand substantially upright (in the view shown) in these holders in base 50 and are designed to receive corresponding contact pins of a light. For example, when a light is inserted into base 50, contacts of the light insert through holes 28, and are positioned adjacent to contacts 121, 122, 123, and 124. Each of these contacts 121, 122, 123, and 124 have associated arms 121.1, 121.2, 122.1, 122.2, 123.1, 123.2, 124.1, and 124.2 (See FIGS. 3A-3D). When the associated light pins insert through holes 28, and the light is rotated, the light pins are rotated outside contact holders 58.1, 58.2, 58.3, and 58.4 and move laterally into associated contacts, by pushing aside associated contact arms 121.1, 121.2 to form a friction fit electrical contact between a contact on a light and contact 121. Each of these arms has a curved leading edge for example curved edges 121.3, and 121.4 to allow the lamp pin to slide therein. Each arm has protrusions 122.5, and 122.6 for coupling to a lamp pin. The remaining light contacts form this same type of friction fit or spring like connection by the rotational movement of the light, rotating rotatable top 20 from a first position to a second position to further secure a light into the lamp holder. In this case, any number of contacts can be used such as two, three, four or more contacts. Contacts 121, 122, 123 and 124 each include a tongue 121.6, 122.6, 123.6, and 124.6. These tongues slide into slots such as slot 59.1 to secure contacts 121, 122, 123, and 124 in place.

Figure 4A:
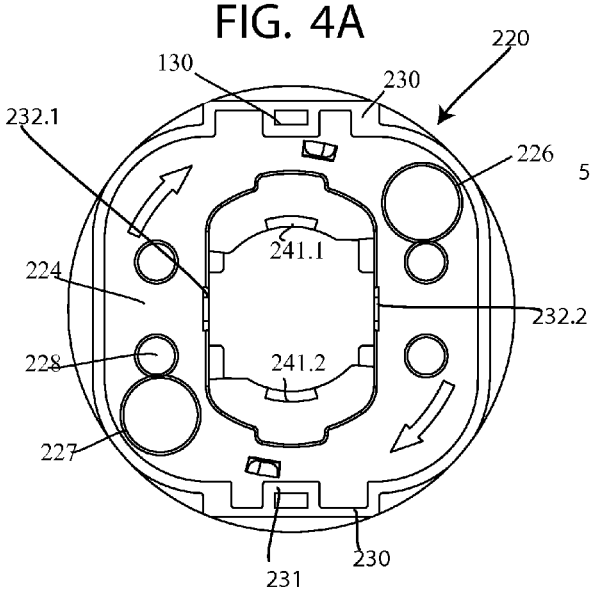
FIG. 4A is a top perspective view of another embodiment of the rotatable top.
Figure 7A:
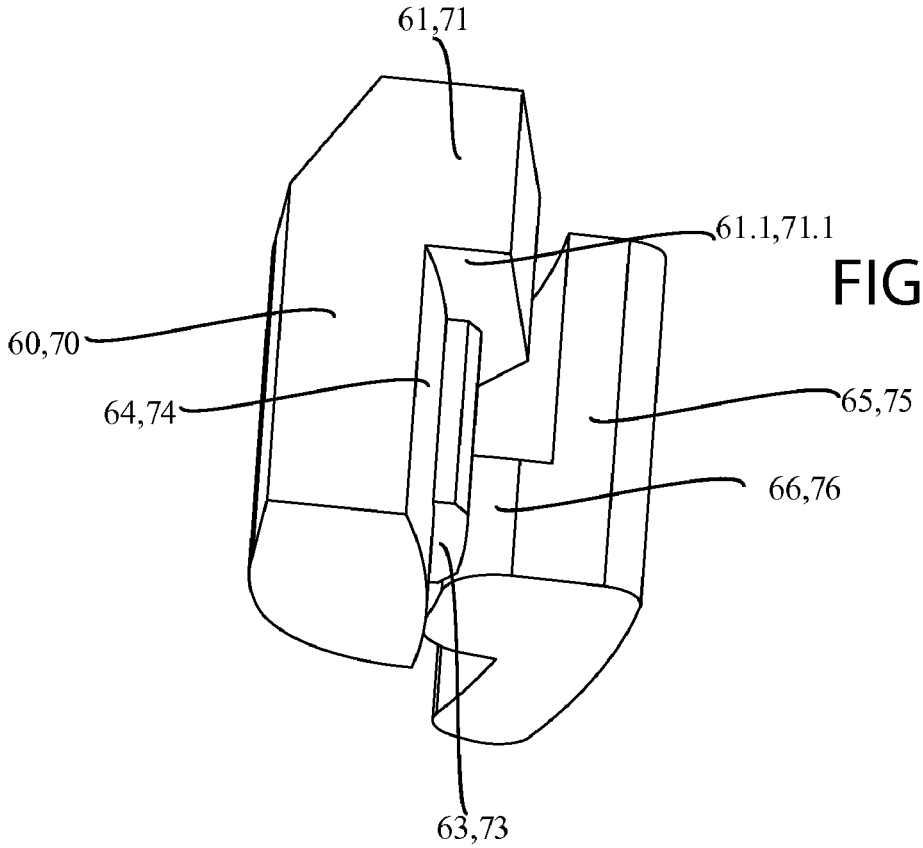
FIG. 7A is a perspective view of a protrusion and a top protrusion in a first position

FIG. 4A shows a top view of another embodiment of the rotatable top in the form of rotatable top 220 (See also FIG. 7A). In this top view, there is a top surface 224, screw holes 226, and 227, and circular lamp pin insertion holes 228. There are also oppositely spaced notches or indents 230, having a counter protrusion 231 extending back in towards a center region of rotatable top 220. These protrusions 231 are for selectively accepting or rejecting a particular light when it is being inserted into rotatable top 20, or rotatable top 220. In addition, securing clips 241.1 and 241.2 (see clips 40) are shown extending inward towards a center region.

Figure 4B:
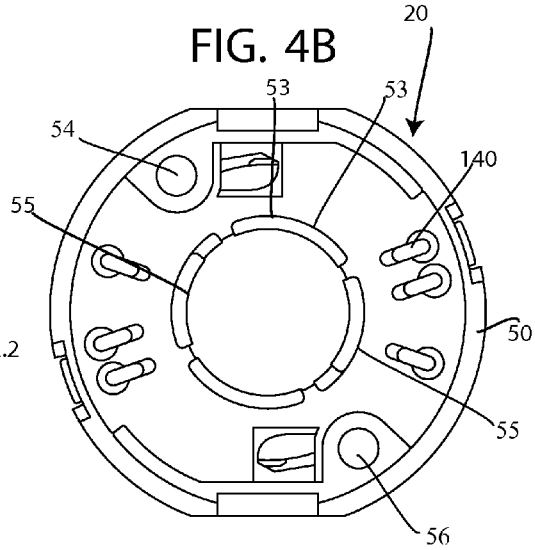
FIG. 4B is a bottom view of the embodiment shown in FIG. 4A and in FIG. 1.

FIG. 4B shows a bottom view of body 50 including screw holes 54 and 56, which extend down from the opposite face (See FIG. 1). These screw holes 54 and 56 allow a screw to pass there-through and then be attached to an adjacent fastening panel. In addition, there are shown flanges 53 and 55 wherein a recessed flange 53 is for receiving a corresponding locking clip 40 with flange section 41 extending over shortened flange section 53 (See FIG. 5). Longer flange section 55 does not engage locking clips 40. In addition, in this view, there are holes 140 for receiving wires for connection to contacts 120. These holes are designed to receive the associated wires so that contacts 120 can be energized.

Figure 4C:
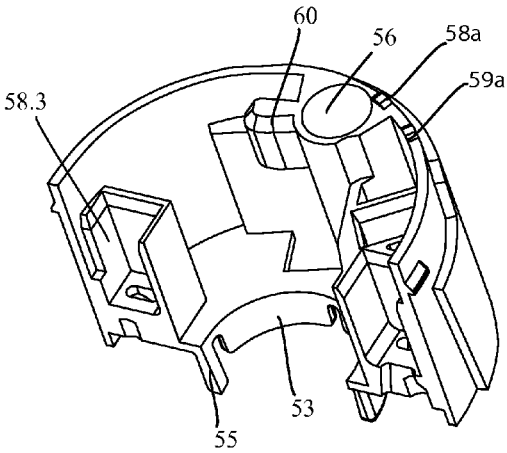
FIG. 4C is a perspective, cut away view of the embodiment shown in FIG. 1.

FIG. 4C shows a perspective view of housing 50 which shows contact holder 58.3 and a first protrusion 60. This view also shows screw hole 56, as well as shortened extension 53 and lengthened extension 55. In addition, detents 58*a* and 59*a* are for creating a snap fit with associated indents on rotatable top 20.

Figure 4D:
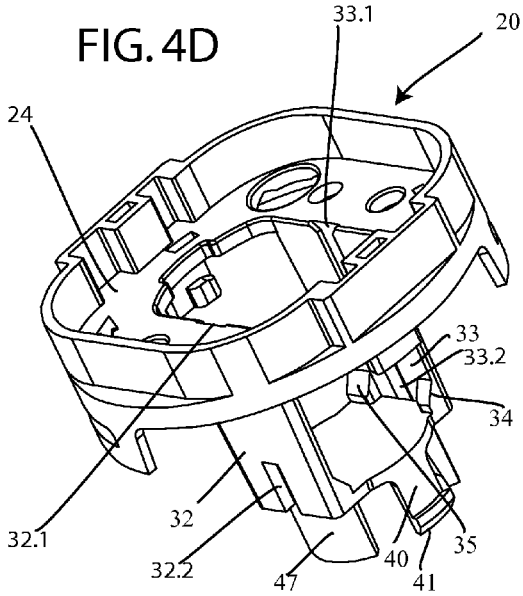
FIG. 4D is a perspective view of the rotatable top shown in FIG. 1.

FIG. 4D shows a perspective view of a rotatable top 20 which includes arms 32 and 33 which extend down from top surface 24. Both arms 32 and 33 have open slots 32.2 and 33.2 for receiving associated locking clips 103.1 and 107.1 (See FIG. 2A). In addition, both arms 32 and 33 have protrusions or flanges 34 and 35 which are used to secure spring clip 100 in place by allowing clips 103.2, and 107.2 to secure between flanges 34 and 35, and clips 103.3, and 107.3 to secure between flanges 34 and 35. In addition, there is shown locking clip 40 having a flange 41 along with a stabilizing arm 47 extending down from arms 32 and 33 and used to rotate within extensions 53 and 55 to form lateral or peripheral support within extensions 53 and 55.

FIG. 5 is a side cross-sectional view of one embodiment wherein this embodiment shows spring clip 100 secured into a rotatable top 20. Rotatable top 20 is rotatably secured into body 50. With this view, there is shown a first protrusion 60 and a second protrusion 70. First protrusion 60 is for meshing with to a first top protrusion 65, which is coupled to rotatable top 20, while second protrusion 70 is for meshing with a second top protrusion 75, which is coupled to rotatable top 20. With the rotation of rotatable top 20, this positions a flange section 61 of first protrusion 60 over a flange section 66 of first top protrusion 65. In addition, the rotation of rotatable top 20 also positions flange section 71 of protrusion 70 over flange section 76 of second top protrusion 75. The meshed or second position of these flanges further secures rotatable top 20 to body section 50. In this way, rotatable top 20 is secured to body section 50 via at least two mechanisms, with protrusion 60 being meshed with top protrusion 65, while protrusion 70 is meshed with top protrusion 75. In addition, clips 40 including flanges 41 are also locked around shortened extension 53 locking rotatable top 20 to body 50 as well in a rotatable manner. This additional securing prevents rotatable top 20 from ejecting or leaving body 50 by sliding out of body 50. Thus, once a light is rotated from a first position into a second or further secured position, a light having light prongs is now electrically connected to contacts 58, and wherein the light, and the rotatable top 20 are also further secured to body 50 as well in multiple different locations. For example, in the first position, the rotatable top is secured to the body via clips 40 meshing with extension 53. In addition, flange 80 is secured into slot 37 as well (See FIG. 1). However, when rotatable top 20 is rotated into the second position these securing arrangements still exist, however, protrusions 65 and 70 are now meshed with top protrusions 65 and 75 creating a further secured arrangement. In addition, in the first position, arms 106 and 108 are bendable peripherally outwards so that with some effort, a lamp can be pulled out from lamp body 50. However, when rotatable top 20 is rotated into the second position, arms 106 and 108 are secured against lateral outward movement by protrusions 60 and 70 pressing on arms 106 and 108, keeping them in place. This second position provides further securement against removal of the light from body 50.

Spring clip 100 is shown inserted into opening 31 of rotatable top 20 with first and second side prongs 103.2 and 103.3 being secured between protrusions 34 and 35 of rotatable top 20. To insert spring clip 100, it is slid down into opening 31 with clip 103.1 sliding down channel 33.1 and then extending out into opening 33.2 to lock spring clip 100 in place. Channels 33.1 and 32.1 are used to guide the insertion of spring clip 100 into rotatable top 20.

Once spring clip 100 is inserted, a center side prong 103.1 extends through opening 33.2 to lock spring clip 100 to rotatable top 20. As shown in this view, spring clip 100 has arms 106 and 108 wherein arm 106 includes first arm sections 106.1 and 108.1 extending out from the base 104 of clip 100. In addition as shown in FIG. 2B arcuate shaped holes 104.1 and 104.2 are for receiving rejection elements 44 and 45. This view shows indented sections 106.2 and 108.2 of arms 106 and 108 respectively, which extend circumferentially in towards a center region of opening 31. In this view clips 106.4 and 108.4 are shown also extending in towards this center region as well. Clips 106.6 and 108.6 are also shown extending in towards center region 31 as well. In this view bridge section 106.3 and bridge section 108.3 are shown contacting first protrusion 60 and second protrusion 70 respectively. This position is set when rotatable top 20 is rotated into the locked or locking position, thereby forcing arms 106 and 108 to bend inward (see arrows) towards center region 31 such as towards center line 231.

Figure 6:
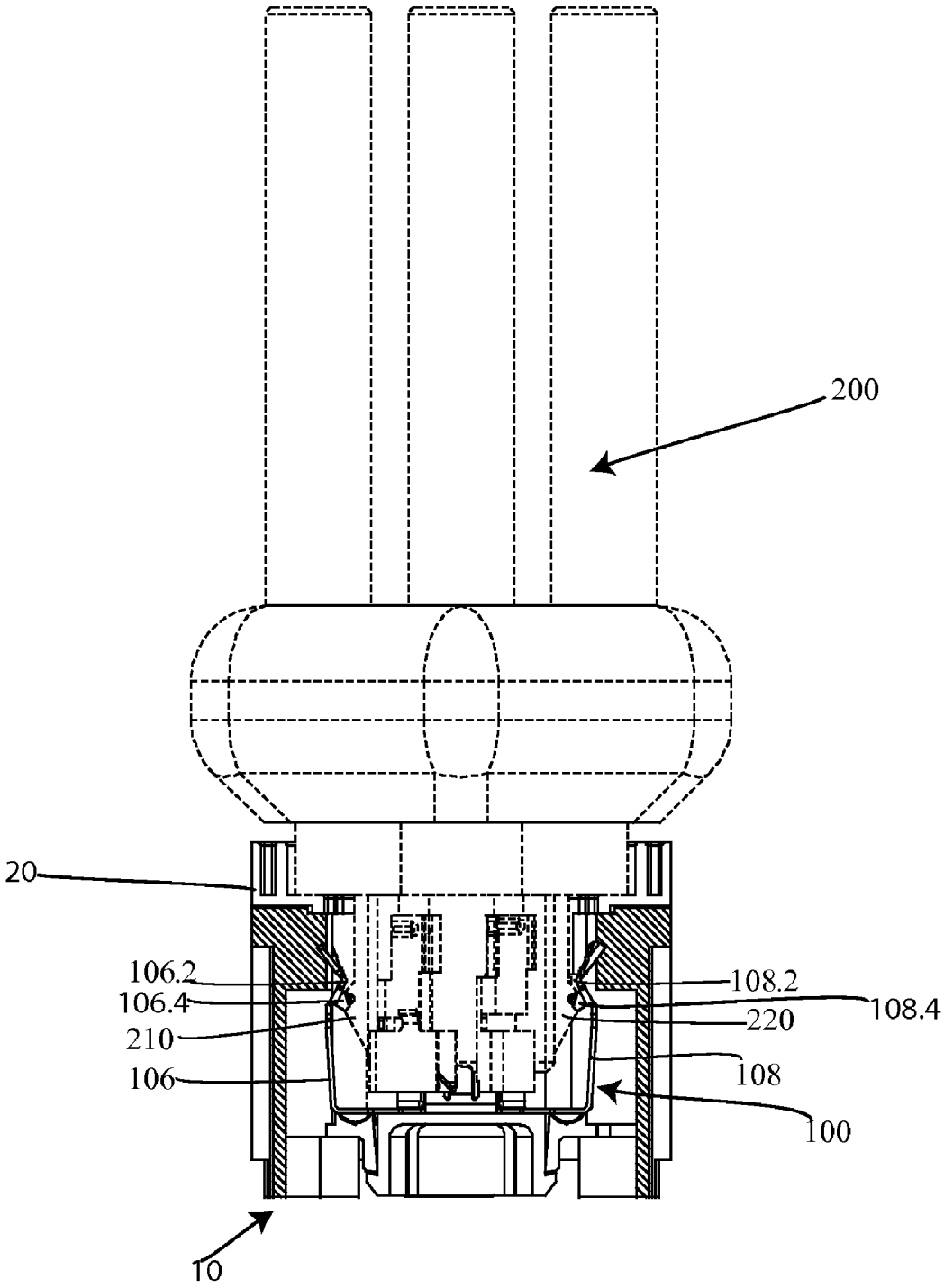
FIG. 6 is a side cross-sectional view of a light inserted into the device.

FIG. 6 shows a side cross-sectional view of a light 200 inserted into the device 10. In this view, flanges 210 and 220 formed on either side of light 200 are used to lock into spring clip 100. When rotatable top 20 is rotated into a non locked position, spring clip arms 106 and 108 are not in contact with protrusions 60 and 70 so that these arms can be pressed peripherally outward to allow for the insertion of light 200 into opening section 31 or the removal of the light from opening 31. When light 200 is inserted into opening 31, flange 210 presses against arm 106, while flange 220 presses against arm 108 both pushing these arms outward as well.

Once light 200 is inserted and snapped in place, it is in its first partially secured position with arms 106 and 108 being movable, but coupled to and extending over flanges 210 and 220. Next, the light can be rotated so that it is rotated into a further secured position. Once light 200 and rotatable top 20 are rotated, bridge sections 106.3 and 108.3 are pressed inward via first protrusion 60 and second protrusion 70 (See FIG. 5) to clamp indented section 106.2 over flange 210 and clamp indented section 108.2 over flange 220 by moving arms 106 and 108 inward. Clips 106.4 and 106.5 and 108.4 and 108.5 (See FIGS. 2A-2D) are used to provide lateral support around flanges 210 and 220 respectively. In this way, arm 106 is rotationally secured around flange 210, while arm 108 is rotationally secured around flange 220. In addition, clips 106.6 and 108.6 (See FIG. 5) form a leading edge to assist in the rotation of spring clip 100 so that these leading edges 106.6 and 108.6 intersects with protrusions 60 and 70 respectively, during rotation, to constrain spring clips 106 and 108 inward as it rotates into protrusions 60 and 70 respectively.

Figure 7B:
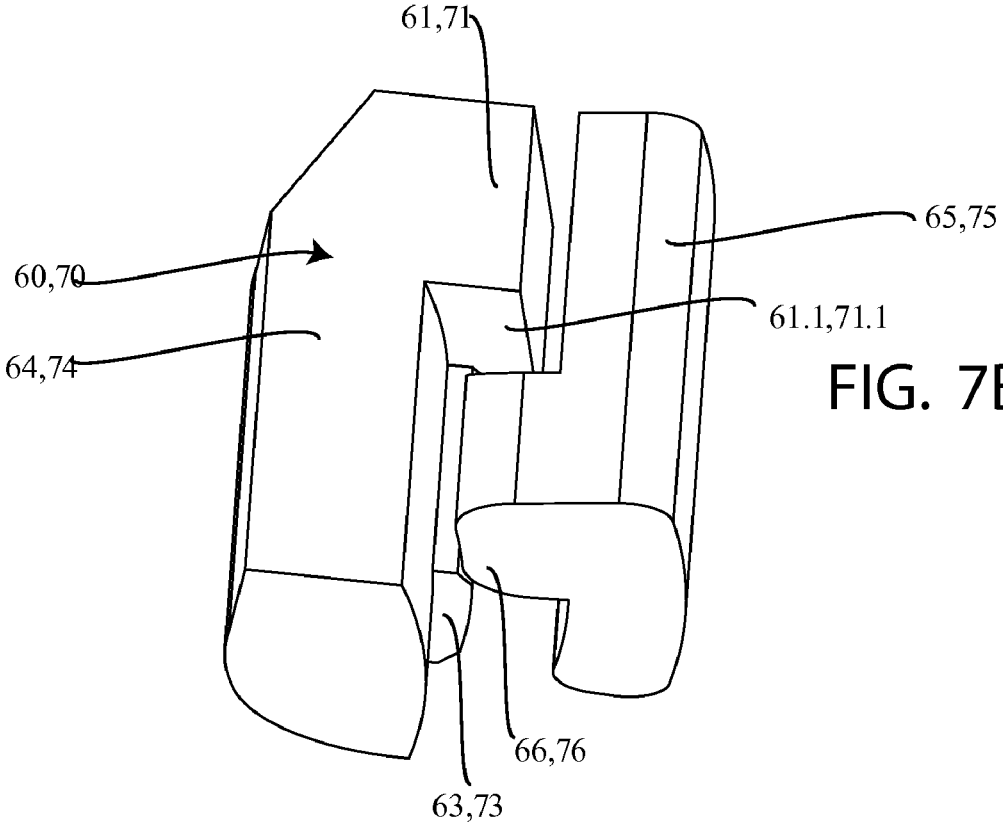
FIG. 7B is a perspective view of a protrusion and a top protrusion in a locked position.

FIGS. 7A and 7B show the meshing between protrusions 60 and 70 and rotatable top protrusions 65 and 75. Protrusions 60 and 70 each have an extending section 61, and 71. In addition, protrusions 60 and 70 each also have a front flange section 63, and 73 respectively, as well as a following opening or recessed section 64 and 74 for receiving a leading flange 66 of top locking section 65, and a leading flange 76 of top locking section 75 respectively.

For example, FIG. 7A shows protrusions 60 or 70 and top protrusions 65 or 75 in a first position wherein rotatable top 20 is in its first position where protrusions 60 and 70 are not meshed with top protrusions 65 and 75. Once rotatable top 20 is rotated into its locked position, (See FIG. 7B) top protrusions 65 and 75 are shown locked over respective protrusions 60 and 70 to form a positive lock. This positive lock is set by protrusion surfaces 61.1 and 71.1 butting against respective leading flanges 66 and 76 to further secure rotatable top 20 to body 50.

Figure 8B:
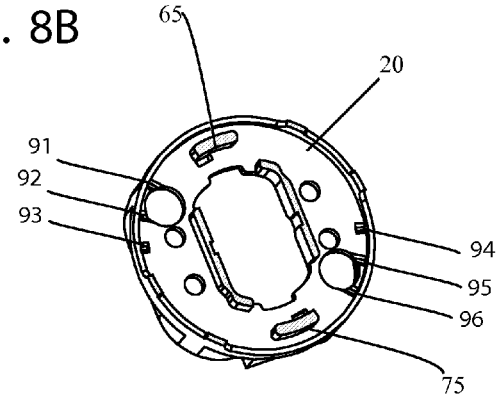
FIG. 8B is an inside cut away view of the rotatable top.
Figure 8C:
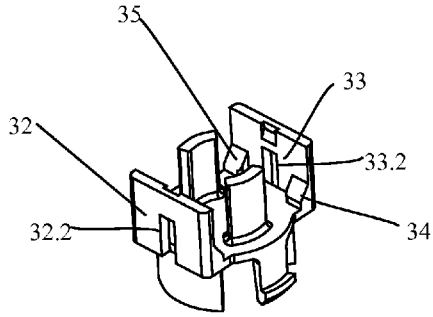
FIG. 8C is a cut away view of legs of the rotatable top.
Figure 8A:
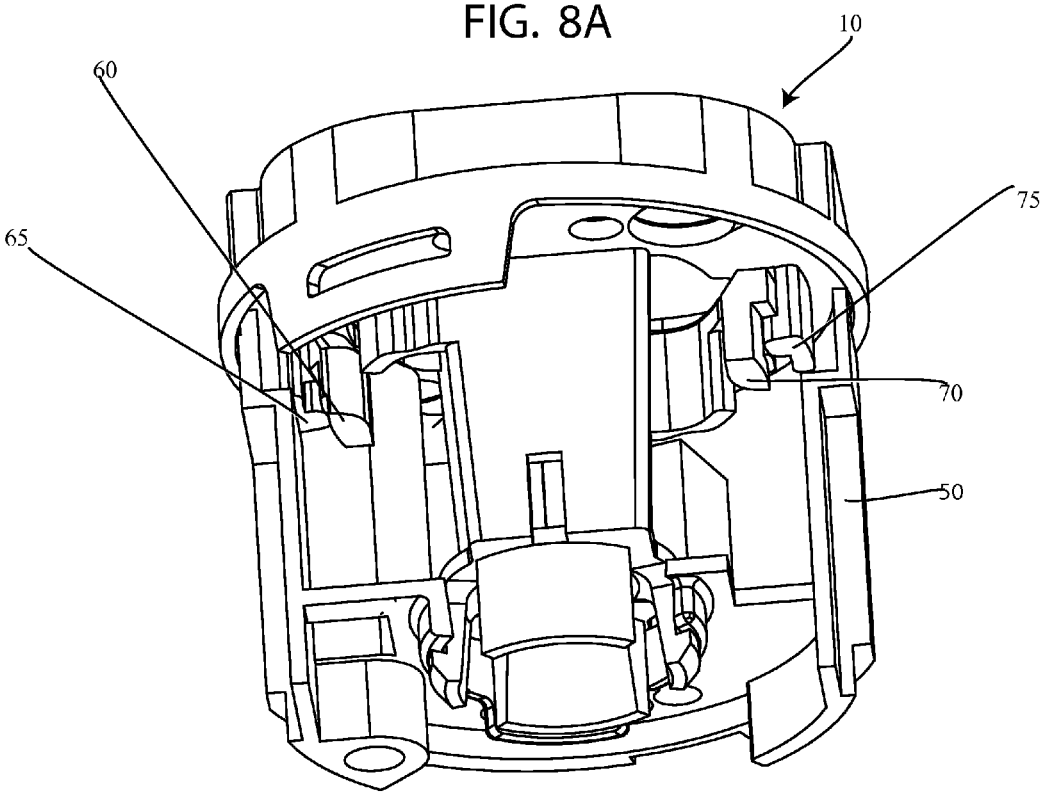
FIG. 8A is a cut away view of the top rotated into a secured position with a base.

Accordingly, FIG. 8A shows a cut away view of body 50 along with rotatable top 20 in a locked position in body 50. In this view, protrusion 60 is shown locked to top protrusion 65 thereby further securing rotatable top 20 to body 50. In addition, protrusion 70 and top protrusion 75 are also shown meshed together.

FIGS. 8B and 8C show cut away views of the rotatable top. For example, FIG. 8B shows a bottom perspective view of rotatable top 20 which has a plurality of indents 91, 92, 93, 94, 95, and 96 disposed around a perimeter region of the inside face of rotatable top 20. This underside view also shows locking elements 65 and 75 as well. These indents are for meshing with protrusions 58*a* and 59*a* (see FIG. 4C) and also protrusions 58*b*, and 59*b* (See also FIG. 9A). FIG. 8C shows arms 32 and 33 in greater detail showing holes 32.2 and 33.2 along with protrusions 34 and 35.

Figure 9A:
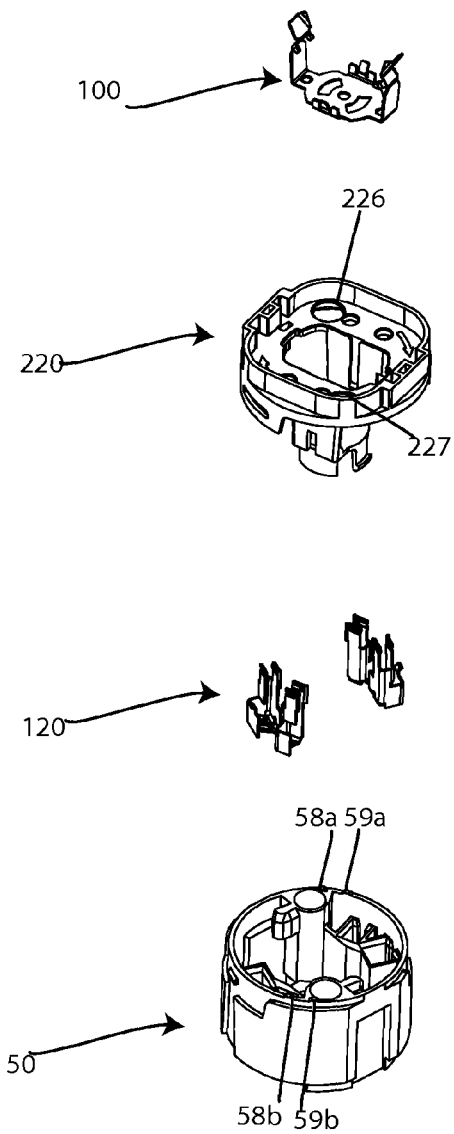
FIG. 9A is an exploded top perspective view of another embodiment of the invention.
Figure 9B:
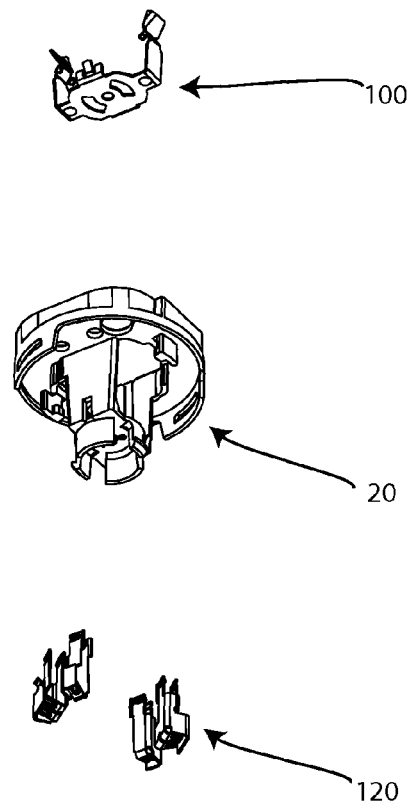
FIG. 9B is an exploded bottom perspective view of the embodiment shown in FIG. 9A.

There are multiple different permutations for these different designs. For example, FIG. 9A shows a top perspective, exploded view of a one permutation which includes a spring clip 100, a rotatable top 220 (See rotatable top 220 in FIGS. 4A-4D), a plurality of contacts 120 and body 50. FIG. 9B shows the bottom perspective exploded view of this design as well. In this view, as shown rotatable top 220 includes screw holes 226 and 227, but does not include rejection features such as rejection features 44 and 45 shown in FIG. 5. In this view, body 50 includes protrusions 58*a*, 58*b*, 59*a*, and 59*b* for selectively meshing with indents 91, 92, 93, 94, 95, 96 of the rotatable top. This meshing occurs in one of two positions, the open position for releasing or inserting a light base, and a closed position for locking a light base in to a lampholder. In each of these positions, the middle indents, 92 and 95 are utilized while the two sets of protrusions 58*a*, 58*b*, 59*a*, and 59*b* shift, thereby selectively moving in and out of the outer indents 91, 93, 94, and 96. These protrusions and indents create a snap fit positioning so that a user turning rotatable top 20 on base 50 would know when the top has reached either the open position or the closed position.

Figure 10A:
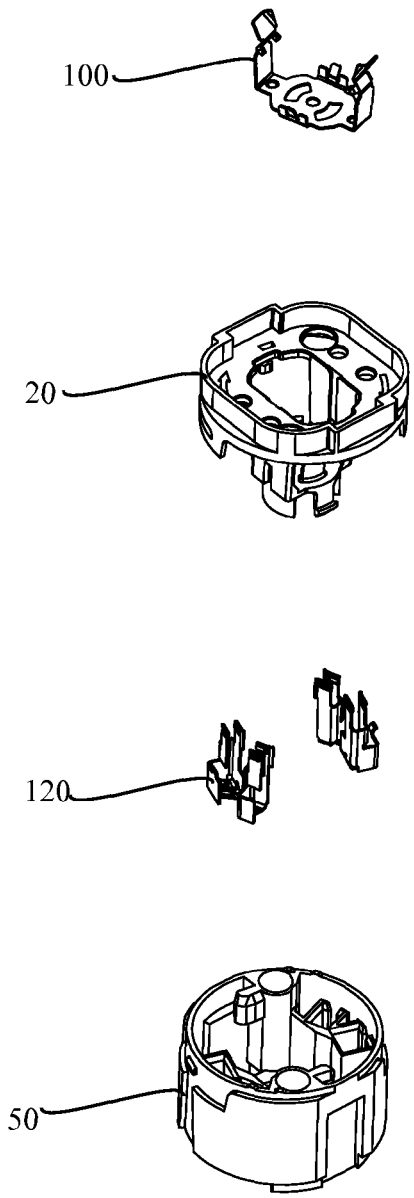
FIG. 10A is an exploded top perspective view of another embodiment.
Figure 10B:
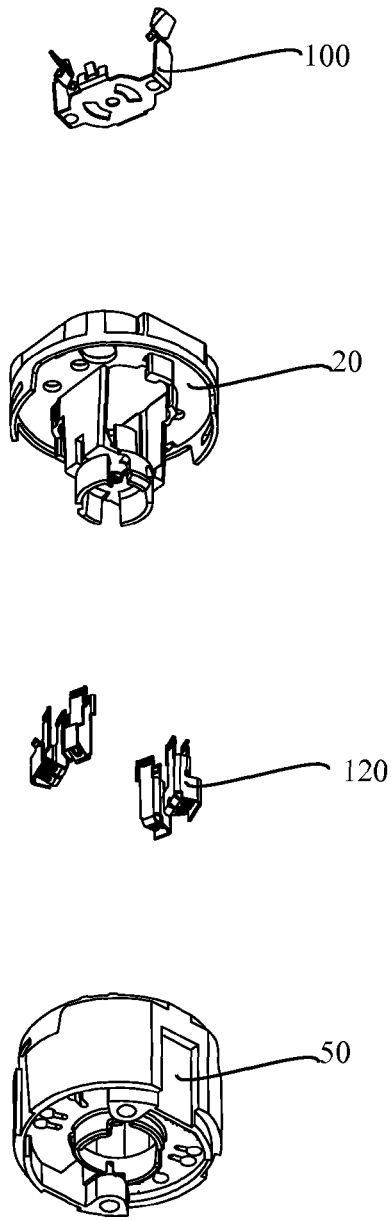
FIG. 10B is an exploded bottom perspective view of the embodiment shown in FIG. 10A.

FIG. 10A shows a top perspective exploded view of another combination of components including spring clip 100, rotatable top 20 (See FIG. 1) contacts 120 and body 50. FIG. 10B shows the bottom perspective exploded view of this permutation shown in FIG. 10A.

Figure 11A:
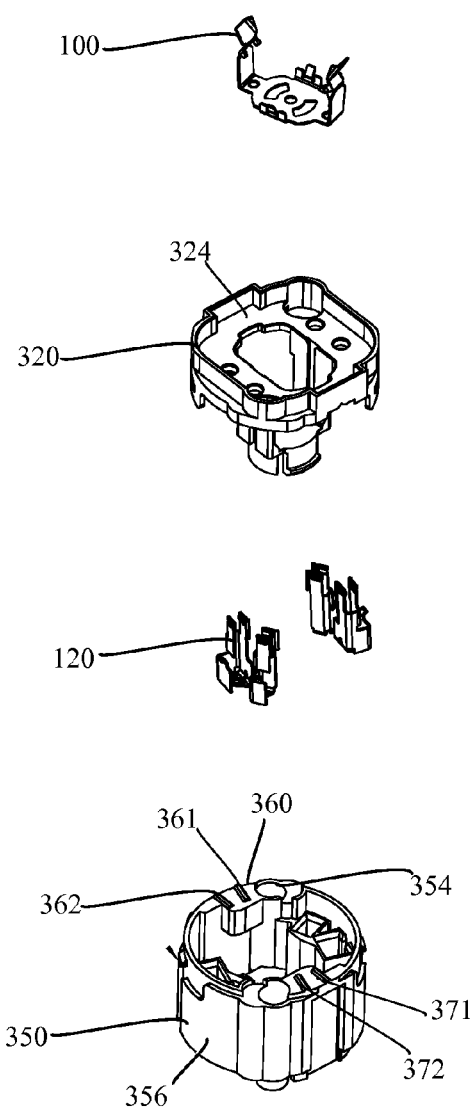
FIG. 11A is an exploded top perspective view of another embodiment.
Figure 11B:
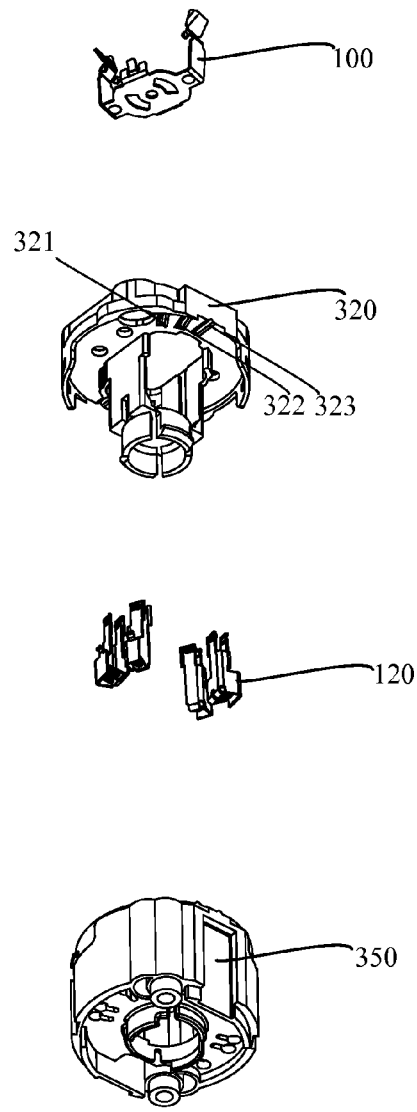
FIG. 11B is an exploded bottom perspective view of the embodiment shown in FIG. 11A.

FIG. 11A shows another permutation which shows spring clip 100, rotatable top 320, contacts 120, and body 350. In addition, FIG. 11B shows a bottom perspective view as well. In this case, rotatable top 320 includes protrusions 321, 322 and 323 which extend down from a top surface 324. Top 320 includes indents 321, 322, and 323, as well as oppositely spaced indents (not shown). Indents 321, 322, and 323 are for meshing with detents 371, and 372, on protrusion 370 while protrusion 360 also includes detents 361, and 362 for meshing with the oppositely spaced indents (not shown). Thus, when rotatable top 320 is in its first, position, indents such as indents 321 and 322 on rotatable top 320 are meshed with corresponding detents 371 and 372 on body 320. When light is moved into a second, more secure position, indents 322 and 323 are now meshed with to the detents 371, and 372 wherein in each of these positions there is created a snap fit lock position with indents 321 and 322 meshed with protrusions 371 and 372 in a first position, and indents 322 and 323 being meshed with detents 371 and 372 in a second position. This snap fit lock position provides a frictional inertia keeping rotatable top 320 from easily rotating back to an unlocked position. In addition, base 350 includes screw holes 354 and 356 each for receiving a screw for fastening base to another part such as a rack.

Figure 12A:
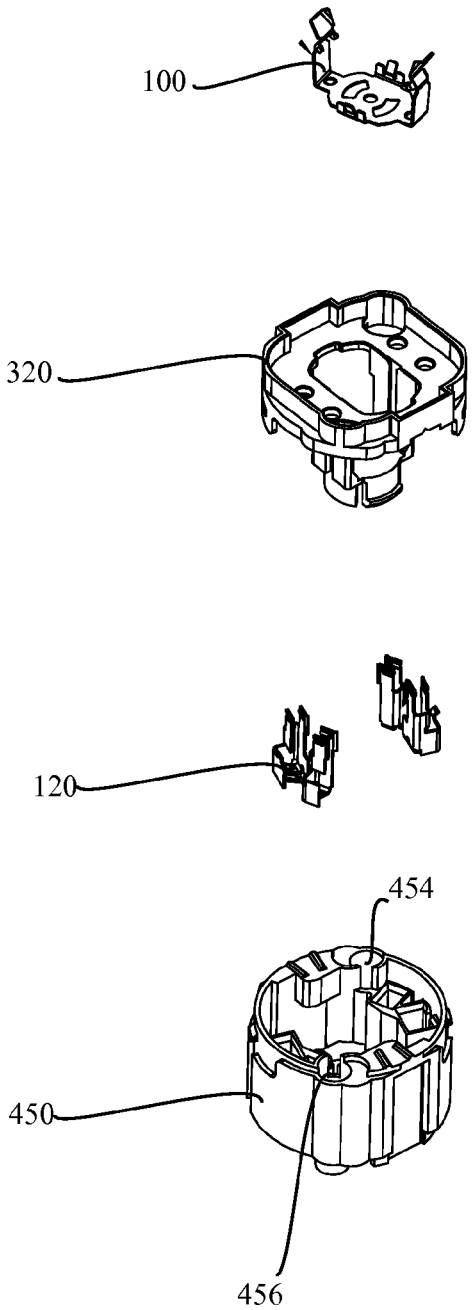
FIG. 12A is an exploded top perspective view of another embodiment.
Figure 12B:
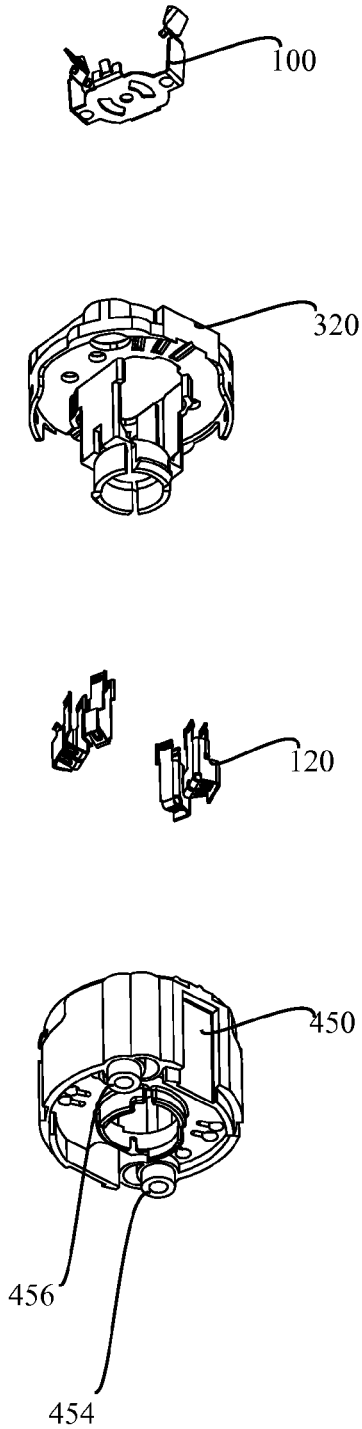
FIG. 12B is an exploded bottom perspective view of the embodiment shown in FIG. 12A.

FIG. 12A shows an exploded top perspective view of another permutation which includes spring clip 100, rotatable top 320, contacts 120, and base 450. Base 450 includes screw holes 454 and 456 which are positioned in a different position than screw holes 354 and 356 of body 350. The different positioning of these screw holes is to provide adjustability in mounting of body 350 or 450 to different racks having different foot prints.

Figure 13A:
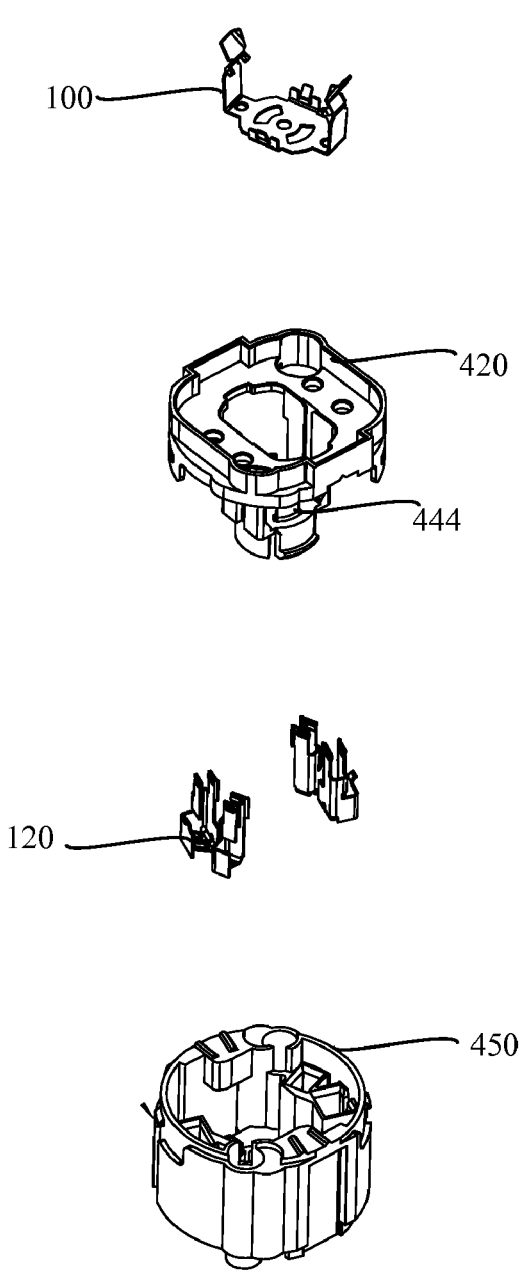
FIG. 13A is an exploded top perspective view of another embodiment.
Figure 13B:
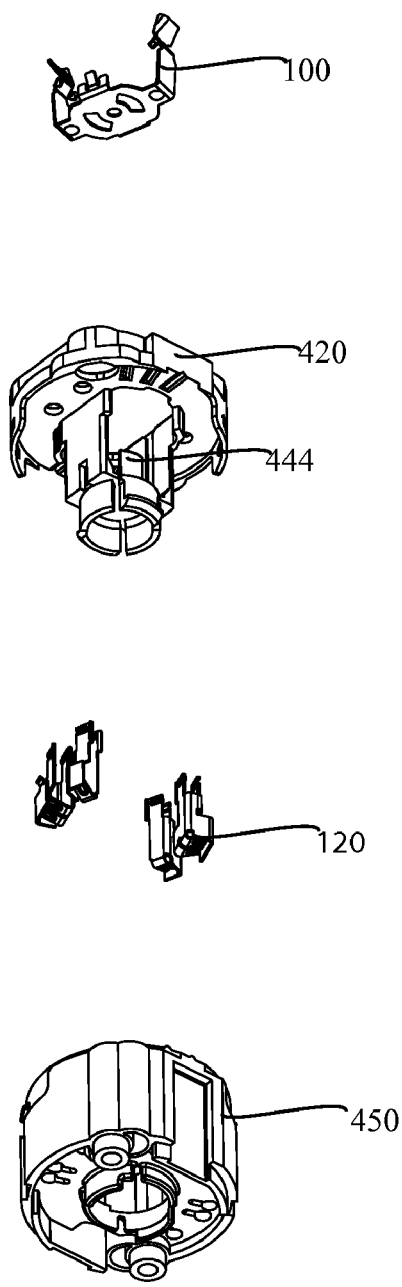
FIG. 13B is an exploded bottom perspective view of the embodiment shown in FIG. 13A.

FIG. 13A shows an exploded top perspective view of another permutation which shows spring clip 100 having a rotatable top 420, contacts 120, and base 450. Rotatable top 420 differs from rotatable top 320 in that it has rejection element 444 and an oppositely spaced rejection element (not shown) for accepting or rejecting a particular light. FIG. 13B shows the exploded bottom perspective view of this permutation as well.

Figure 14A:
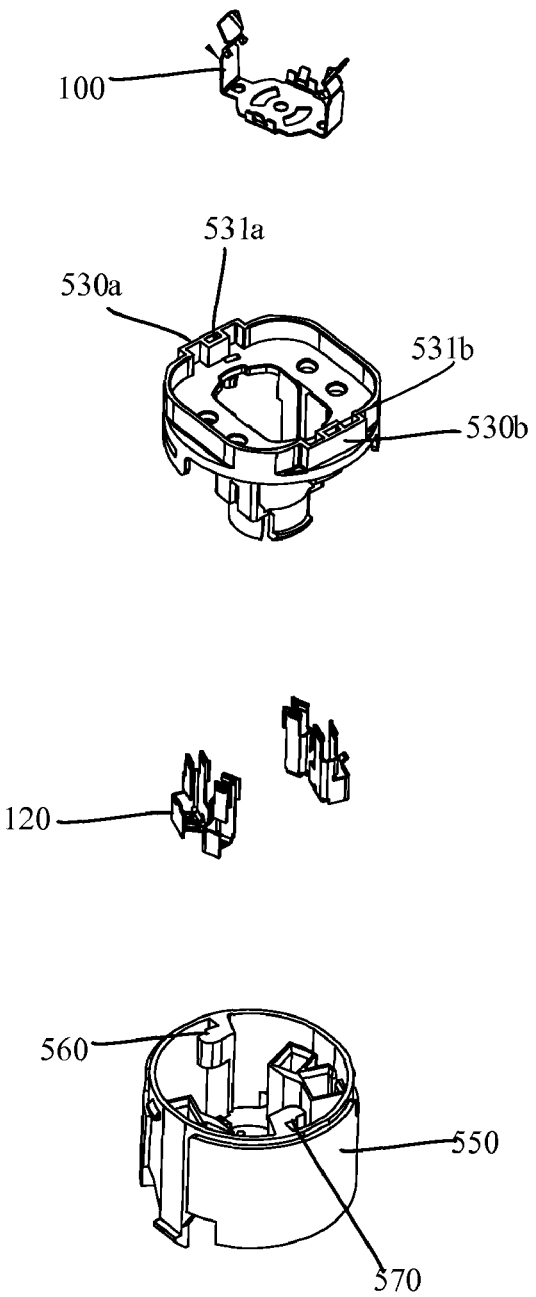
FIG. 14A is an exploded top perspective view of another embodiment.
Figure 14B:
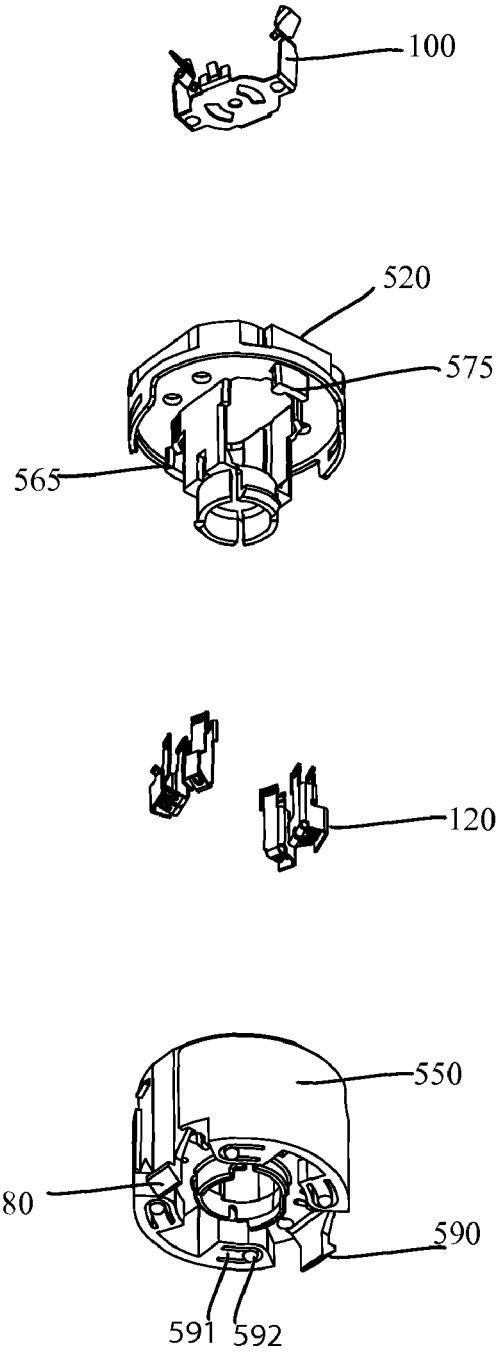
FIG. 14B is an exploded bottom perspective view of the embodiment shown in FIG. 14A.

FIG. 14A shows an exploded top perspective view of another permutation which includes spring clip 100, rotatable top 520 which includes notches or indents 530*a* and 530*b*, along with rejection elements 531*a* and 531*b* serving to reject light bases of a particular geometry from inserting into rotatable top 520. In addition, this view shows contacts 120 as well as body 550 including protrusions 560 and 570. Protrusions 560 and 570 are for selectively locking with top protrusion 565 and 575 (See FIG. 15B) of rotatable top 520 in a manner described above. In addition, body 550 includes clips 580 and 590 which allow body 550 to be clipped onto an adjacent support rather than screwed on as described above. Thus, this embodiment or permutation does not include screw holes in either rotatable top 520 or body 550. In addition, as shown in this embodiment, there is a leaf spring 591 having a detent 592 for providing pressure for securing body 550 to a backing in a prestressed manner to keep body 550 from unnecessary movement. These leaf springs 591 and detents 592 can be utilized on the other bodies 50, 350, 450, and 650 as well.

Figure 15A:
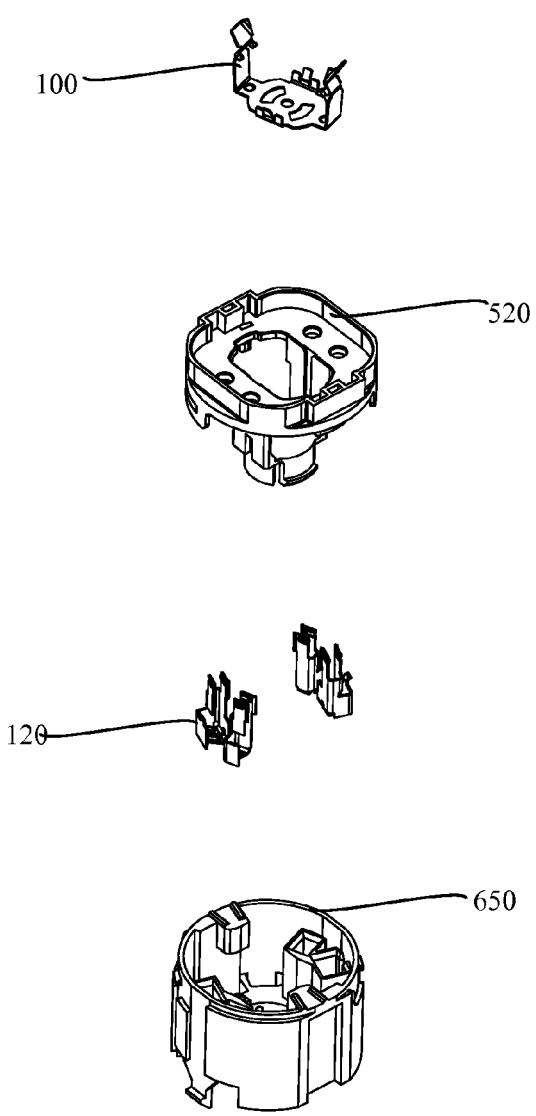
FIG. 15A is an exploded top perspective view of another embodiment of the invention.
Figure 15B:
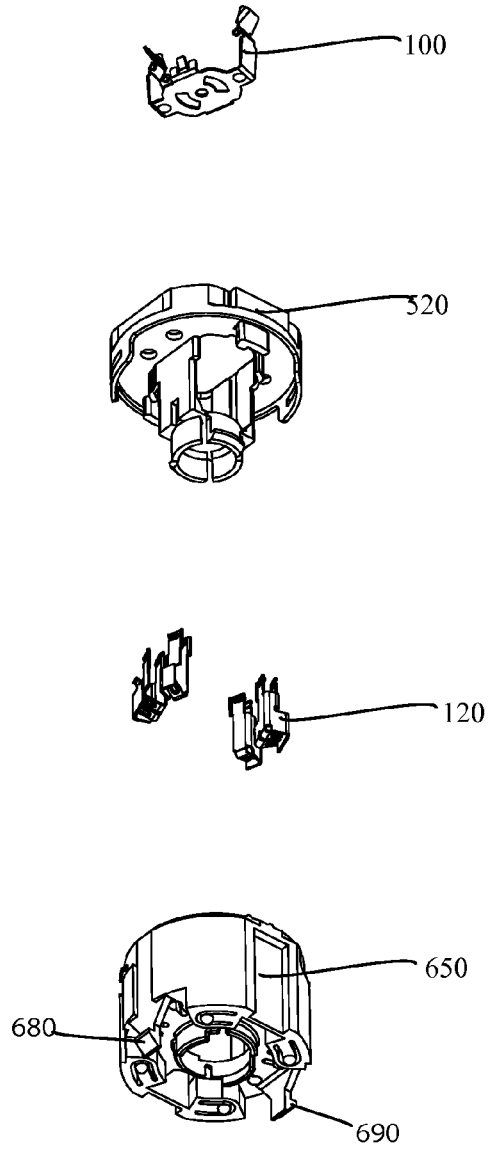
FIG. 15B is an exploded bottom perspective view of another embodiment of the invention.

FIG. 15A shows another permutation showing spring clip 100, rotatable top 520 contacts 120 and body 650. In this view body 650 is similar to body 350 however this body does not include screw holes such as screw holes 354 and 356. Instead, this body includes clips 680 and 690 for securing body 650 to a support.

Figure 16A:
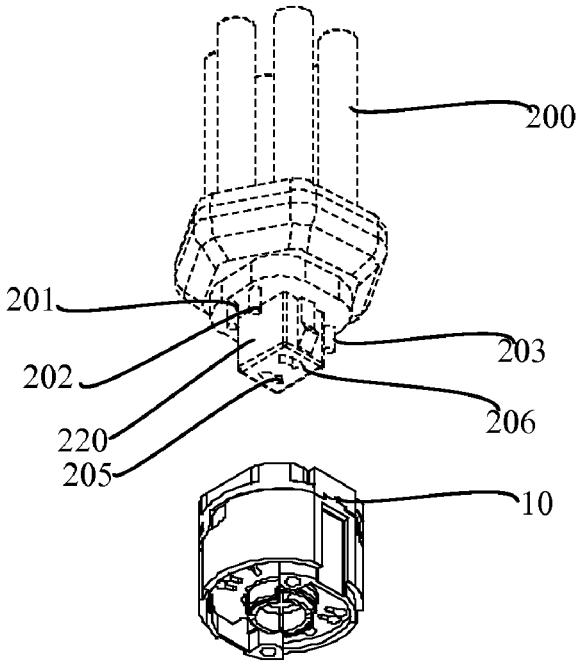
FIG. 16A is a bottom perspective view of a light being inserted into a lampholder.
Figure 16B:
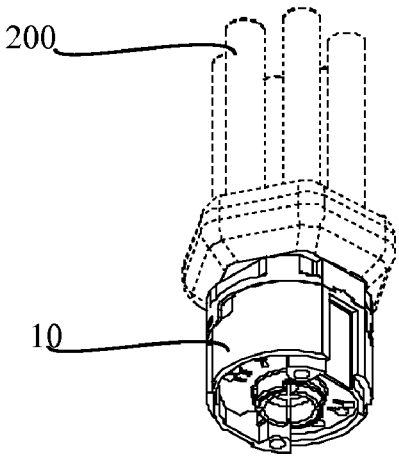
FIG. 16B is a bottom perspective view of the light which has inserted into the lampholder.

FIG. 16A shows a bottom perspective view of a light 200 which is positioned for insertion into device 10. As shown, this light includes light prongs or contacts 201, 202, and 203, a locking flange 220, as well as shaped holes 205 and 206 which are adapted to receive rejection elements 44 and 45. Once light 200 is inserted, it can then be rotated into a locked position as shown in FIG. 16B.

Thus, the different designs create a device which have a resilient element such as spring clip 100 for selectively securing a light into spring clip which is in turn is secured to a lampholder. In addition, because rotatable tops 20, 220, 520, each have top locking elements, they also form an additional locking feature locking rotatable tops to their respective bases when these rotatable tops are rotated into locking positions. In addition rotatable tops 20, 220, 320, 420, and 520 are each equipped with protrusions for creating a snap fit connection, when the rotatable top is rotated into its locked position thereby creating a secure locked position for a respective light.

Figure 17A:
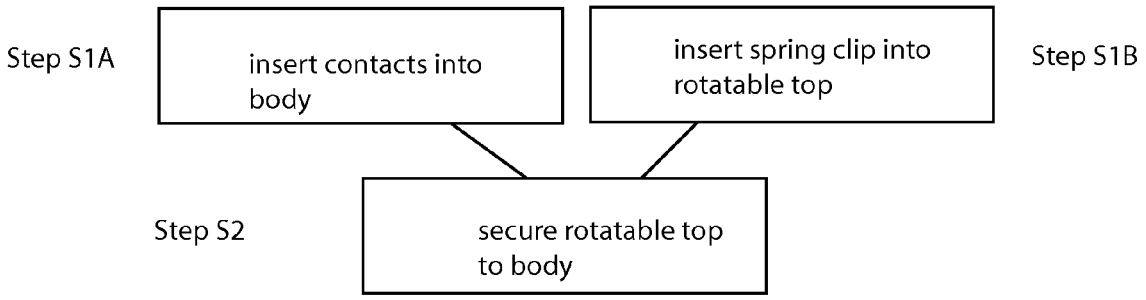
FIG. 17A is a flow chart showing the process for assembling the device.

FIG. 17A is a flow chart showing the process for assembling the device. For example, there is shown in a first step S1A the step of inserting contacts into a body. Step S1B involves inserting a spring clip into a rotatable top. These two steps can occur in any order. Once the contacts such as contacts 58 are positioned inside the body such as body 50, and the spring clip such as spring clip 100 is positioned and secured to rotatable top such as rotatable top 20, then the rotatable top can be secured to the body in step S2.

Figure 17B:
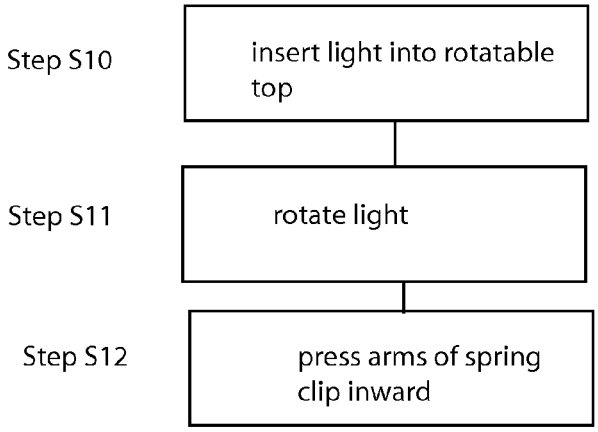
FIG. 17B is a flow chart showing the process for inserting and securing a light using the device of FIG. 1.

FIG. 17B is a flow chart showing the process for inserting and securing a light using the device of FIG. 1. In step S10, a light is inserted into a rotatable top (See for example FIG. 6) so that the light body is coupled to the spring clip. Next in step S11 the light such as light 200 is rotated which rotates the rotatable top such as rotatable top 20 and the spring clip such as spring clip 100. This rotation is from for example a first position to a second position as described above. Thus in step S12, the arms of the spring clip intersect with protrusions such as protrusions 60 and 70 on body 50 so that arms 106 and 108 are pressed inward towards the light body to further secure the light body to body 50.

Accordingly, while only a few embodiments of the present invention have been shown and described, it is obvious that many changes and modifications may be made thereunto without departing from the spirit and scope of the invention.

What is claimed is:

1. A lamp holder device for holding a light, having a light body, the device comprising:

a) a body wherein said body further comprises a guide flange extending out from a peripheral region of said body;

b) a plurality of contacts disposed in said body;

c) at least one rotatable top rotatably coupled to said body; and d) at least one spring clip coupled to said at least one rotatable top, said at least one spring clip disposed to selectively secure to the light body, to hold the light in said body.

2. The lamp holder as in claim 1, wherein said rotatable top further comprises a slot which is disposed to receive said guide flange coupled to said body.

3. The lamp holder as in claim 1, wherein said rotatable top further comprises at least one rim and at least one indent disposed in said at least one rim for receiving a geometric profile of a light base inserted into said at least one rotatable top.

4. The lamp holder as in claim 1, wherein said at least one rotatable top having a front surface further comprises at least one indent disposed in said rotatable top, opposite said front surface on said rotatable top, and wherein said at least one body further comprises at least one detent, wherein said at least one detent is adapted to insert into said indent on said at least one rotatable top.

5. A lamp holder device for holding a light, having a light body, the device comprising:

a) a body;

b) a plurality of contacts disposed in said body;

c) at least one rotatable top rotatably coupled to said body; and d) at least one spring clip coupled to said at least one rotatable top, said at least one spring clip disposed to selectively secure to the light body, to hold the light in said body wherein said at least one spring clip has at least one base section, and at least one arm coupled to said base section.

6. The lamp holder device as in claim 5, wherein said at least one arm further comprises at least one protrusion section forming a ridge.

7. The lamp holder device as in claim 5, wherein said at least one arm further comprises at least one prong extending out from said at least one arm.

8. The lamp holder as in claim 7, further comprising at least one additional prong coupled to said at least one arm, said at least one additional prong disposed opposite said at least one prong, forming a channel on said at least one arm.

9. The lamp holder as in claim 5, wherein said at least one base section has an opening that is an arcuate opening which forms a hole for receiving a rejection element.

10. The lamp holder as in claim 1, wherein said body further comprises at least one contact holder for receiving at least one of said plurality of contacts.

11. The lamp holder as in claim 5, wherein said body further comprises a protrusion, extending into an inner region of said body, wherein when the light is inserted into said body, and rotated, said at least one rotatable top and said at least one spring clip is disposed to rotate from a first position to a second position wherein in said second position, said at least one spring clip is in contact with said at least one protrusion.

12. The lamp holder as in claim 11, wherein said at least one rotatable top further comprises at least one top protrusion coupled to said top, wherein when said at least one rotatable top is rotated from a first position to a second position, said top protrusion meshes with said at least one protrusion coupled to said body.

13. The lamp holder as in claim 11, wherein said at least one protrusion comprises an overhang and wherein said at least one top protrusion comprises a protruding section, wherein said overhang on said at least one protrusion meshes with a protruding section of said at least one top protrusion to further secure the rotatable top to the body.

14. A lamp holder device for holding a light, having a light body, the device comprising:

a) a body;

b) a plurality of contacts disposed in said body;

c) at least one rotatable top rotatably coupled to said body; and d) at least one spring clip coupled to said at least one rotatable top, said at least one spring clip disposed to selectively secure to the light body, to hold the light in said body;

wherein said at least one rotatable top further comprises at least one screw hole and said body further comprises at least one screw hole which is adapted to receive at least one screw for coupling said body to a support.

15. A lamp holder device for holding a light, having a light body, the device comprising:

a) a body;

b) a plurality of contacts disposed in said body;

c) at least one rotatable top rotatably coupled to said body; and d) at least one spring clip coupled to said at least one rotatable top, said at least one spring clip disposed to selectively secure to the light body, to hold the light in said body wherein said rotatable top further comprises at least one arm wherein said at least one arm comprises at least one channel which is adapted to guide said at least one spring clip into said rotatable top.

16. The lamp holder as in claim 15, wherein said body further comprises at least one extension wherein said at least one arm on said at least one rotatable top has a flange which is disposed to rotatably lock with said at least one extension on said body to lock said rotatable top to said body.

17. A lamp holder device for holding a lamp, the device comprising:

a) a body having at least one protrusion;

b) a plurality of contacts disposed in said body;

c) at least one rotatable top rotatably coupled to said body; and wherein said at least one rotatable top comprises at least one protrusion, wherein said at least one rotatable top is rotatable from a first position to a second position, wherein when said at least one rotatable top is in said second position said protrusion on said at least one rotatable top is meshed with said protrusion on said body; and d) at least one spring clip coupled to said rotatable top, and having a base section and a plurality of arms coupled to said base section, wherein said base section further comprises a plurality of tabs coupled to said base section, wherein said at least one arm on said rotatable top further comprises a slot for receiving at least one of said plurality of tabs.

18. The lamp holder as in claim 17, wherein said body further comprises a plurality of detents, and said at least one rotatable top further comprises a plurality of indents for receiving said plurality of detents, said plurality of detents and said plurality of indents for providing a snap fit connection for said indents and detents in both said first position and said second position.

19. The lamp holder as in claim 17, wherein said at least one spring clip is formed from a metallic material.

20. The lamp holder as in claim 19, wherein said at least one rotatable top further comprises at least one arm, and wherein said at least one spring clip is coupled to said at least one arm on said at least one rotatable top.

21. A process for securing a light having a light body to a lamp holder having a body, a rotatable top coupled to the body and at least one spring clip having a base section and arms, the spring clip being coupled to the rotatable top, the process comprising the following steps:

inserting the light into said rotatable top so that the light body is coupled to the at least one spring clip;

rotating the light, which rotates the rotatable top and the at least one spring clip; and pressing the arms of the spring clip towards the light body over flanges on the light body.

22. The process as in claim 21, wherein said spring clip has at least two arms wherein when said rotatable top is rotated, said arms on said spring clip are disposed to be constrained to secure over flanges on the light body.

23. The process as in claim 21, wherein said step of inserting said light into said body includes inserting a light body having flanges on the light body pushing laterally out against the arms on the at least one spring clip when said light is being inserted into the body.

24. A process for assembling a lamp holder comprising:

a) inserting a plurality of contacts into a body;

b) coupling a spring clip having a base section and arms to a rotatable top; and c) coupling said rotatable top to said body.

25. The process as in claim 24, further comprising the step of coupling at least one electrical power line to at least one of said plurality of contacts by inserting said at least one electrical power line through a hole in said body.

* * * * *